United States Patent [19]

Yokoe

[11] Patent Number: 4,742,742

[45] Date of Patent: May 10, 1988

[54] APPARATUS FOR SEVERING ELONGATE PRODUCT

[75] Inventor: Kazuo Yokoe, Kurobe, Japan

[73] Assignee: Yoshida Kogyo K. K., Tokyo, Japan

[21] Appl. No.: 914,187

[22] Filed: Oct. 1, 1986

[30] Foreign Application Priority Data

Oct. 8, 1985 [JP] Japan ..... 60-154018[U]
Feb. 14, 1986 [JP] Japan ..... 61-19636[U]

[51] Int. Cl.[4] ..... B26D 1/08

[52] U.S. Cl. ..... 83/101; 83/140; 83/165; 83/459; 83/921

[58] Field of Search ..... 83/134, 140, 143, 165, 83/176, 454, 459, 460, 636, 101, 921

[56] References Cited

U.S. PATENT DOCUMENTS 1,745,476 2/1930 Cohn ..... 83/101
3,559,518 2/1971 Domka ..... 83/140
4,213,385 7/1980 Dahlem ..... 83/176
4,386,465 6/1983 Ezaki ..... 83/140

*Primary Examiner*—E. R. Kazenske
*Assistant Examiner*—Hien H. Phan
*Attorney, Agent, or Firm*—Hill, Van Santen, Steadman & Simpson

[57] ABSTRACT

An elongate product such as a surface fastener or a slide fastener chain is cut off on a lower cutter blade by an upper cutter blade moving toward and coacting with the lower cutter blade. While the elongate product is being severed, it is pressed down against a base board by a first pressure pad. A severed piece is positively discharged off the upper and lower cutter blades by a second pressure pad which moves with the upper cutter blade. The second pressure pad includes a brush of electrically conductive bristles for removing static electricity from the elongate product and the severed piece.

7 Claims, 7 Drawing Sheets

APPARATUS FOR SEVERING ELONGATE PRODUCT

BACKGROUND OF THE INVENTION

1. Field of the Invention

The present invention relates to an apparatus for severing an elongate product such as a surface fastener, a slide fastener chain, an ornamental tape, an elongate piece of cloth, or a sheet of paper, for example, to desired lengths.

3. Description of the Prior Art

Known apparatus for cutting elongate products are generally composed of a vertically movable upper cutter blade, a fixed lower cutter blade positioned for coaction with the upper cutter blade, and a vertically movable pressure pad for pressing an elongate product to be severed, the pressure pad being disposed upstream of the upper and lower cutter blades with respect to the direction in which the elongate product is delivered. The elongate product is cut on the lower cutter blade by the upper cutter blade as it is moved downwardly past the lower cutter blade in contact therewith, while the elongate product is being immovably held by the pressure pad.

Some elongate products have a pressure-sensitive adhesive layer coated on one surface thereof and a peel-off strip of paper applied to the pressure-sensitive adhesive layer. When such an elongate product is severed, the pressure-sensitive adhesive layer is squeezed out of the cut edge under the force applied by the upper and lower cutter blades. The squeezed mass of adhesive sticks to the cutter blades and prevents the severed piece from being separated from the cutter blades for being discharged out of the apparatus. When this happens, the severed piece tends to be cut again or damaged by the cutter blades.

The upper cutter blade is held in sliding contact with the lower cutter blade during the severing of the product, and static electricity is developed in the cutter blades and the product being cut thereby. Therefore, the severed piece tends to be triboelectrically attracted to the cutter blades, and may not be smoothly discharged from the apparatus. During continued operation of the apparatus, the severed piece which sticks to the cutter blades is highly likely to be cut again or damaged by the cutter blades. To solve this problem, the apparatus also includes a static electricity remover for removing static electricity generated when cutting the product by applying a voltage. However, the static electricity remover of this type is expensive and is required to be installed as a separate unit on the apparatus.

SUMMARY OF THE INVENTION

It is an object of the present invention to provide an apparatus for severing an elongate product, having means for accurately cutting the product and positively discharging a severed piece without damaging the same.

Another object of the present invention is to provide an apparatus for severing an elongate product, having simple means for removing static electricity which is generated at the time the product is cut.

According to the present invention, there is provided an apparatus for severing an elongate procuct, including a pressure pad movably disposed adjacent to and downstream of cutter blades with respect to the direction of feed of the elongate product for positively discharging a severed piece off the cutter blades. The pressure pad is movable with a cutter blade which coacts with a fixed cutter blade to cut the elongate product. The pressure pad includes a brush of electrically conductive bristles for removing static electricity from the elongate product and the severed piece.

Many other advantages and features of the present invention will become manifest to those versed in the art upon making reference to the detailed description and the accompanying sheets of drawings in which two preferred structural embodiments incorporating the principles of the present invention are shown by way of illustrative example.

DETAILED DESCRIPTION

Figure 1:
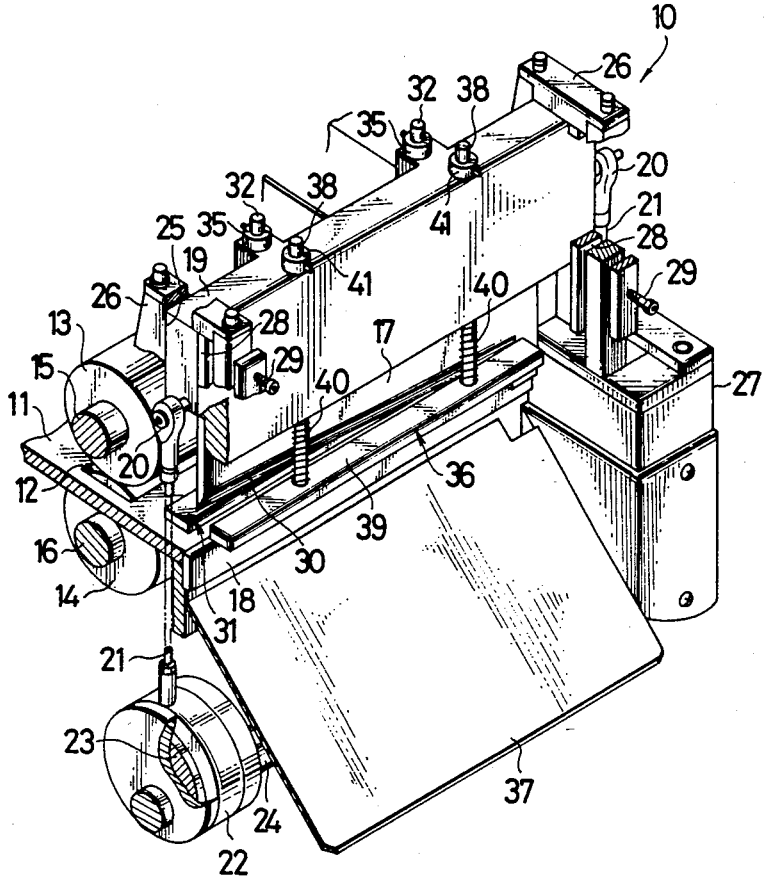
FIG. 1 is a perspective view, partly broken away, of an apparatus for severing an elongate product according to one embodiment of the present invention.

Similar or corresponding parts are denoted by like reference numerals throughout the several views.

The principles of the present invention are particularly useful when embodied in an apparatus such as shown in FIG. 1, generally designated by the reference numeral 10.

The apparatus 10 includes a horizontal base board 11 for supporting an elongate product L (FIG. 2A) thereon, the base board 11 having a transvese slot 12 near a front end thereof. A pair of upper and lower feed rollers 13, 14 is disposed across the base board 11 for feeding the elongate product L while sandwiching the same therebetween, the upper feed roller 13 being positioned over the base board 11 and the lower feed roller 14 underneath the base board 11. The lower feed roller 14 is partly received in the slot 12 and held in contact with the upper feed roller 13. The upper and lower feed rollers 13, 14 are mounted on respective shafts 15, 16 which can be driven by a stepping motor (not shown), for example, to rotate the feed rollers 13, 14 intermittently so that the elongate product L can be fed over a certain interval and then stopped.

The apparatus 10 also includes a vertically movable upper cutter blade 17 and a fixed lower cutter blade 18 coacting with the upper cutter blade 17 for cutting the elongate product L, the upper and lower cutter blades 17, 18 being positioned near the front end of the base board 11. The upper cutter blade 17 is mounted on an upper cutter blade holder 19 which extends transversely of the base board 11. The upper cutter blade holder 19 has a pair of swivel bearings 20 on opposite ends thereof, respectively, with rods 21 being connected at upper ends to the swivel bearings 20, respectively. The rods 21 have lower ends connected to upper portions of outer rings 22 (one shown in FIG. 1) slidably mounted on respective eccentric rings 23 fixedly mounted on a rotatable shaft 24 lying below and extending transversely of the base board 11. The shaft 24 can be rotated about its own axis by a motor (not shown) to move the rods 21 and hence the upper cutter blade holder 19 vertically up and down.

The upper cutter blade holder 19 is received at its opposite ends in vertical grooves 25 defined respectively in two guides 26 joined to a frame 27 and spaced from each other in the transverse direction of the base board 11. Therefore, the upper cutter blade holder 19 is guided by the vertical grooves 25 while it is being vertically moved by the rods 21. A vertical holder presser 28 is disposed in each of the vertical grooves 25 and is normally urged by compression coil springs (not shown) on screws 29 to resiliently press the upper cutter blade holder 19 toward the upper feed roller 13. Therefore, when the upper and lower cutter blades 17, 18 engage each other, the upper cutter blade 17 is resiliently held against the lower cutter blade 18 to provide intimate sliding engagement therebetween for sharply cutting the product L. The forces with which the upper cutter blade 17 is pressed against the lower cutter blade 18 can be adjusted by turning the screws 29.

The upper cutter blade 17 has a lower cutting edge 30 inclined longitudinally with respect to the lower cutting blade 18 which extends horizontally parallel to the base board 11. Therefore, the elongate product L can be progressively severed transversely from one edge to the other by the upper cutter blade 17, and the downward force applied by the rods 21 to the upper cutter blade holder 19 may be relatively small.

The upper cutter blade holder 19 may be vertically moved by any other device such as a pneumatic cylinder, a hydraulic cylinder, an electro-magnetic solenoid, instead of the illustrated eccentric driver mechanism.

Figure 2A:
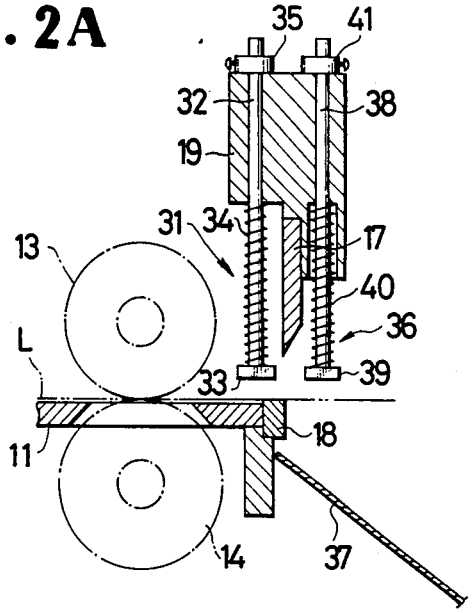
FIGS. 2A through 2D are fragmentary vertical cross-sectional views showing progressive procedural steps of cutting an elongate product on the apparatus shown in FIG. 1.

As shown in FIGS. 1 and 2A, the lower cutter blade 18 is fixed to the front end of the base board 11 transversely therealong in vertical alignment with the upper cutter blade 17 for sliding engagement therewith to cut the elongate product L.

As better illustrated in FIG. 2A, a first pressure pad 31 is vertically movably supported on the upper cutter blade holder 19 for pressing the elongate product L downwardly against the base board 11. The first pressure pad 31 is positioned immediately upstream of the upper cutter blade 17 with respect to the direction in which the elongate product L is moved by the feed rollers 13, 14 across the upper and lower cutter blades 17, 18. The first pressure pad 31 comprises a pair of spaced vertical rods 32 slidably extending through the upper cutter blade holder 19 and a presser foot 33 attached to the lower ends of the vertical rods 32 and extending along the cutter blades 17, 18. The presser foot 33 is normally urged to move downwardly toward the base board 11 by compression coil springs 34 disposed around the vertical rods 32 and acting between the presser foot 33 and the upper cutter blade holder 19. Ring-shaped stoppers 35 are adjustably mounted on the upper ends of the vertical rods 32 which project upwardly from the upper cutter blade holder 19. The forces with which the presser foot 33 is pressed downwardly are therefore adjustable by the ring-shaped stoppers 35. The presser foot 33 is positioned below the lower cutting edge of the upper cutter blade 17 so that the presser foot 33 can hold the elongate product L prior to the severing of the latter by the upper cutter blade 17. When the elongate product L is cut by the upper and lower cutter blades 17, 18, it tends to be displaced transversely since it is severed progressively transversely. Therefore, the presser pad 31 should be pressed downwardly by the compreesion coil springs 34 in order to prevent such transverse displacement of the elongate product L while it is being severed by the upper and lower cutter blades 17, 18.

Figure 2B:
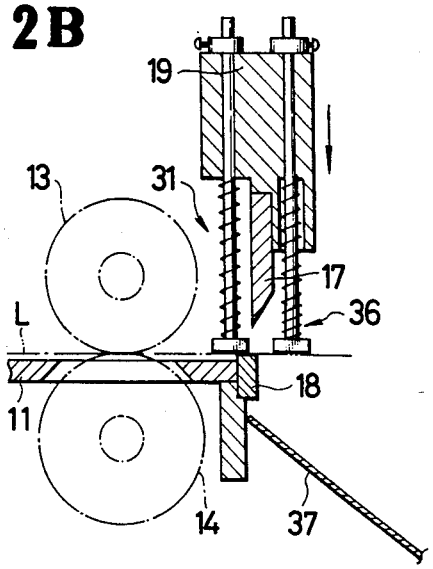

A second pressure pad 36 is vertically movably supported on the upper cutter blade holder 19 for positively discharging a severed piece S (FIG. 2D) onto a discharge chute 37 disposed downstream of the upper and lower cutter blades 17, 18. The second pressure pad 36 is positioned immediately downstream of the upper cutter blade 17. The second pressure pad 36 comprises a pair of spaced vertical rods 38 slidably extending through the upper cutter blade holder 19 and a presser foot 39 attached to the lower ends of the vertical rods 38 and extending along the cutter blades 17, 18. The presser foot 39 is normally urged to move downwardly toward the discharge chute 37 by compression coil springs 40 disposed around the vertical rods 38 and acting between the presser foot 39 and the upper cutter blade holder 19. Ring-shaped stoppers 41 are adjustably mounted on the upper ends of the vertical rods 38 which project upwardly from the upper cutter blade holder 19. The ring-shaped stoppers 41 can adjust the forces with which the presser foot 39 is pressed downwardly. The presser foot 39 is positioned below the lower cutting edge of the upper cutter blade 17 so that the presser foot 39 can engage the elongate product L prior to the severing of the latter by the upper cutter blade 17. As shown in FIGS. 2A and 2B, the presser feet 33, 39 are normally positioned at substantially the same level. The presser foot 39 should be pressed downwardly by the compression springs 40 in order not to displace the elongate product L excessively downwardly and in order to positively discharge the severed piece S (FIG. 2D) downwardly off the upper and lower cutter blades 17, 18.

Operation of the apparatus shown in FIG. 1 will be described with reference to FIGS. 2A through 2D.

Figure 2C:
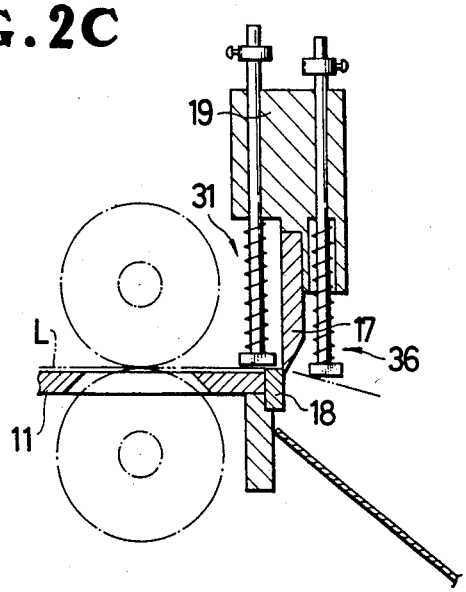
Figure 2D:
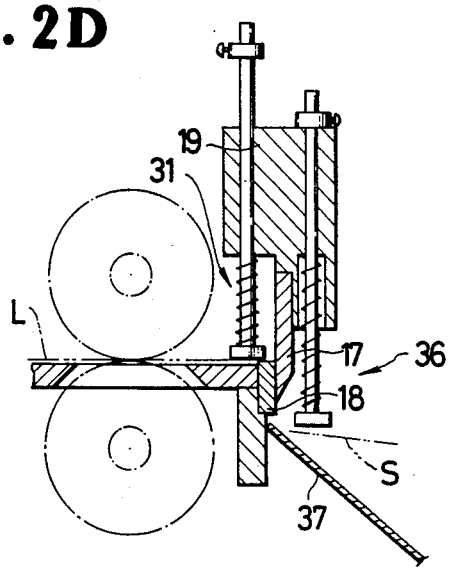

As shown in FIG. 2A, the elongate product L is fed by the feed rollers 13, 14 until its front end projects beyond the base board 11 for a desired interval. Then, the upper cutter blade holder 19 is lowered to cause the first pressure pad 31 to press the elongate product L against the base board 11, as illustrated in FIG. 2B. The upper cutter blade holder 19 is continuously moved downwardly to bring the upper cutter blade 17 into engagement with the lower cutter blade 18, as shown in FIG. 2C. By fully lowering the upper cutter blade holder 19 as shown in FIG. 2D, the elongate product L which is being held in position by the first pressure pad 31 is cut by the upper and lower cutter blades 17, 18, and a severed piece S is positively pushed downwardly by the second pressure pad 36 until the severed piece S is completely separated off the upper and lower cutter blades 17, 18 and discharged onto the discharge chute 37. Therefore, the severed piece S will not be cut again or damaged by repeated operation of the upper and lower cutter blades 17, 18.

Figure 3:
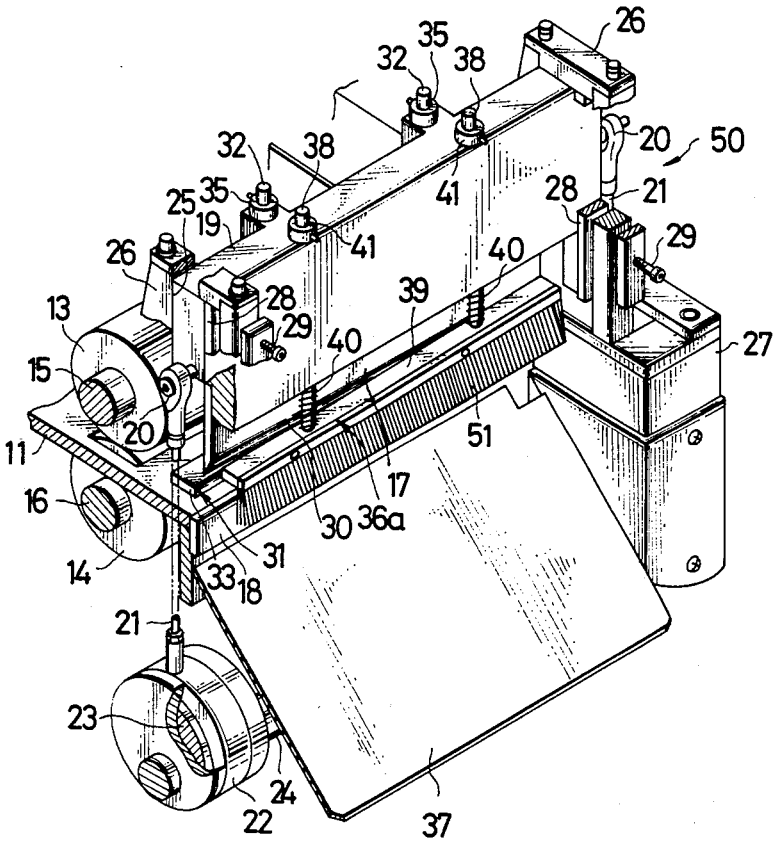
FIG. 3 is a perspective view, partly broken away, of an apparatus for severing an elongate product according to another embodiment of the present invention.

FIG. 3 shows an apparatus for severing an elongate product according to another embodiment of the present invention. The apparatus, generally denoted by the reference numeral 50, is similar to the apparatus 10 shown in FIG. 1, except that a second pressure pad 36*a* includes a brush 51 attached to and extending along a downstream edge of the presser foot 39, the brush 51 projecting downwardly toward the discharge chute 37. The brush 51 is composed of carbon or stainless steel bristles of small diameter for removing static electricity from a severed piece in contact with the brush 51. The length of the brush 51 along the presser foot 39 is substantially the same as the width of the elongate product L to be cut. The brush 51 is mounted on the presser foot 39 so that it can be adjusted in vertical position.

Figure 4A:
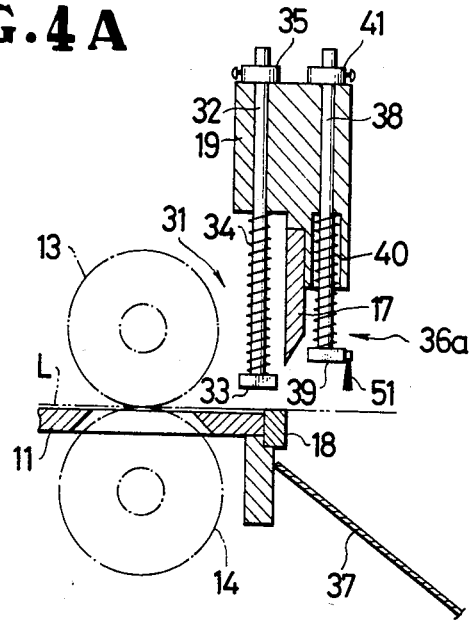
FIGS. 4A through 4D are fragmentary vertical cross-sectional views showing progressive procedural steps of cutting an elongate product on the apparatus illustrated in FIG. 3.
Figure 4B:
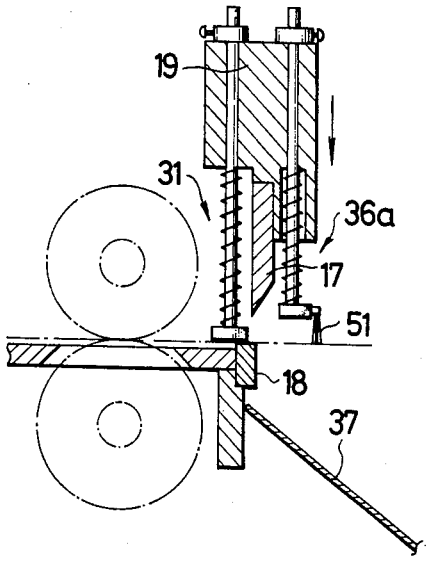
Figure 4C:
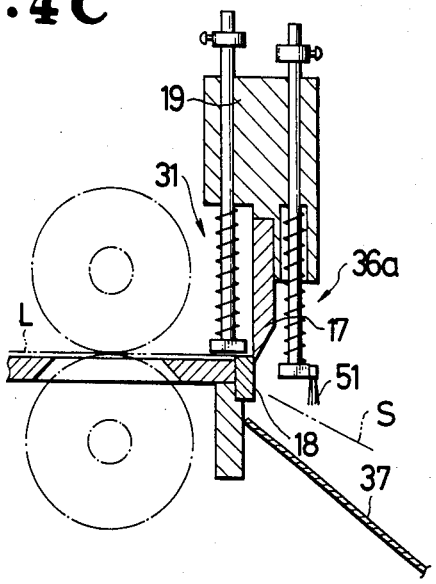
Figure 4D:
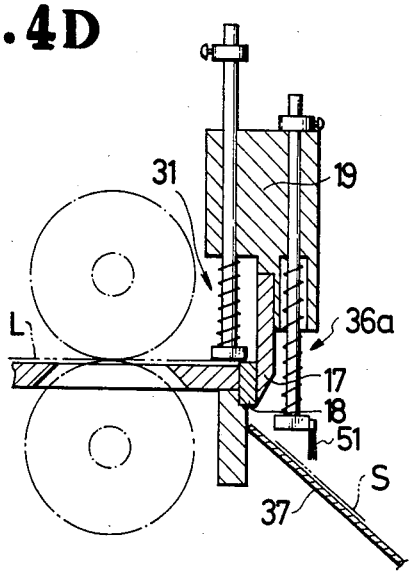

In operation, as shown in FIG. 4B, the brush 51 moves downwardly with the upper cutter blade holder 19 toward the front end portion of the elongate product L as it is fed beyond the front end of the base board 11, immediately before the elongate product L is severed by the upper and lower cutter blades 17, 18. When the brush 51 is positioned closely to the elongate product L, the brush 51 causes the elongate product L to self-discharge static electricity developed thereon through the brush 51. After the elongate product L has been cut to produce a severed piece S, the brush 51 descending with the upper cutter blade holder 19 positively forces the severed piece S off the upper and lower cutter blades 17, 18, as illustrated in FIG. 4C. Upon continued downward movement of the upper cutter blade holder 19, as shown in FIG. 4D, the brush 51 is positioned near the severed piece S on the discharge chute 37 to cause the severed piece S to self-discharge static electricity which has subsequently been developed on the severed piece S. Therefore, the severed piece S can be discharged smoothly on the discharge chute 37 without electrostatically sticking to the upper and lower cutter blades 17, 18 and the discharge chute 37.

As shown in FIG. 4A, before the upper cutter blade holder 19 starts descending the lower end of the brush 51 is positioned substantially at the same level as or slightly higher than the presser foot 33 of the first pressure pad 31. When the upper cutter blade holder 19 is in its lowermost position, as shown in FIG. 4D, the lower end of the brush 51 is located in the vicinity of the severed piece S on the discharge chute 37 to remove static electricity from the severed piece S.

The optimum distance between the lower end of the brush 51 and the elongate product L or the severed piece S for enabling the elongate product L or the severed piece S to self-discharge static electricity through the brush 51 can be achieved by adjusting the vertical position of the brush 51 on the presser foot 39 or the vertical position of the stopper 41 on the rod 38.

Figure 5:
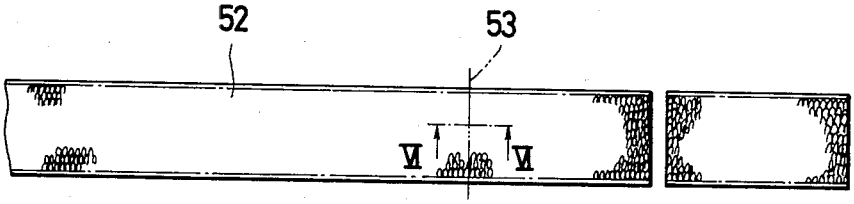
FIG. 5 is a fragmentary plan view of a surface fastener which can be severed by the apparatus of the present invention.
Figure 6:
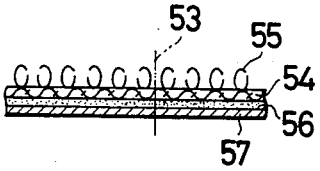
FIG. 6 is an enlarged cross-sectional view taken along line VI—VI of FIG. 5.

FIG. 5 shows a surface fastener 52 as one example of elongate product L that can be cut by the apparatus of the invention along a transverse line 53. As illustrated in FIG. 6, the surface fastener 52 comprises a base fabric piece 54 having a multiplicity of loops 55 for engaging hooks on a companion surface fastener (not shown), a pressure-sensitive adhesive layer 56 coated on the back surface of the base fabric piece 54, and a peel-off strip 57 of paper applied to the pressure-sensitive adhesive layer 56.

Figure 7:
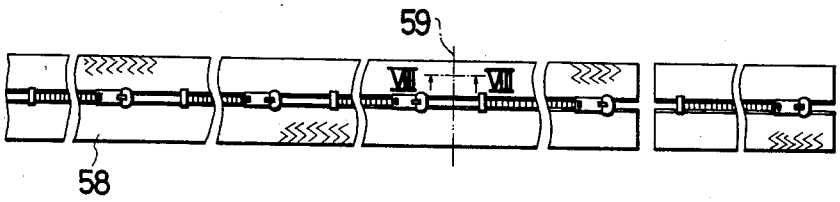
FIG. 7 is a fragmentary plan view of a slide fastener chain which can be severed by the apparatus of the present invention.
Figure 8:
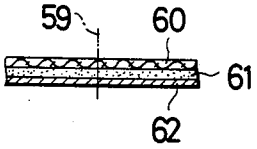
FIG. 8 is an enlarged cross-sectional view taken along line VIII—VIII of FIG. 7.

FIG. 7 shows a slide fastener chain 58 as another example of elongate product L which can be severed by the apparatus of the invention along a transverse line 59. The slide fastener chain 58 is composed of a stringer tape 60, a pressure-sensitive adhesive layer 61 coated on the back surface of the stringer tape 60, and a peel-off strip 62 of paper applied to the pressure-sensitive adhesive layer 61. The severed piece separated from the slide fastener chain 58 along the line 59 serves as an individual slide fastener.

When the surface fastener 52 or the slide fastener chain 58 is cut by the apparatus of the invention, the severed piece can be separated off the upper and lower cutter blades 17, 18 smoothly and discharged downwardly on the discharge chute 37 by the second pressure pad 36, 36*a* even if some adhesive is squeezed out from the adhesive layer 56, 61, tending to stick to the upper and lower cutter blades 17, 18.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for severing an elongate product, comprising:

a base board for supporting the elongate produduct;

means for feeding the elongate product in a direction on said base board;

a first cutter blade fixedly disposed on an end of said base board;

a second cutter blade movable toward said first cutter for coaction therewith to cut the elongate product into a severed piece;

a first pressure pad movably disposed adjacent to and upstream of said first and second cutter blades with respect to said direction for pressing the elongate product against said base board;

a second pressure pad movably disposed adjacent to and downstream of said first and second cutter blades with respect to said direction for discharging the severed piece off said first and second cutter blades, a movable holder supporting said second cutter blade, said first and second pressure pads being movably mounted on said movable holder, a discharge tray disposed downstream of said first and second cutter blades for receiving the severed piece, said first pressure pad comprising at least one first rod slidably supported on said movable holder, a first presser foot, and a first spring disposed around said first rod for normally urging sais presser foot toward said base board, said second pressure pad comprising at least one second dord slidably supported on said movable holder, a presser foot, and a second spring disposed around said second rod for normally urging said second presser foot toward said discharge tray, and a brush mounted on and extending along a downstream edge of said second presser foot for removing static electricity from the elongate product and the severed piece.

2. An apparatus according to claim 1, said brush comprising a plurality of electrically conductive bristles directed toward said discharge chute.

3. An apparatus according to claim 2, said bristles being made of carbon.

4. An apparatus according to claim 2, said bristles being made of stainless steel.

5. An apparatus for severing an elongate product comprising:

a base board for supporting the elongate product;

means for feeding the elongate product in a direction on said base board;

a first cutter blade fixedly disposed on an end of said base board;

a second cutter blade movable toward said first cutter blade for coaction therewith to cut the elongate product into a severed piece;

a first pressure pad movably disposed adjacent to and upstream of said first and second cutter blades with respect to said direction for pressing the elongate product against said base board;

a second pressure pad movably disposed adjacent to and downstream of said first and second cutter blades with respect to said direction for discharging the severed piece off said first and second cutter blades, said second pressure pad including a brush for removing static electricity from the elongate product and the severed piece, said brush comprising a plurality of electrically conductive bristles.

6. An apparatus according to claim 5, said bristles being made of carbon.

7. An apparatus according to claim 5, said bristles being made of stainless steel.

* * * * *